United States Patent [19]

Mitsch

[11] Patent Number: 5,044,566

[45] Date of Patent: Sep. 3, 1991

[54] SEWAGE PUMP WITH SELF-ADJUSTING CUTTERS

[75] Inventor: Brian M. Mitsch, Perrysville, Ohio

[73] Assignee: General Signal Corporation, Stamford, Conn.

[21] Appl. No.: 457,456

[22] Filed: Dec. 27, 1989

[51] Int. Cl.[5] ..... B02C 23/00; B02C 18/40

[52] U.S. Cl. ..... 241/46.04; 241/46.06; 241/259.3; 241/290; 415/121.1

[58] Field of Search ..... 241/290, 46.04, 46.06, 241/259.3; 415/121.1

[56] References Cited

U.S. PATENT DOCUMENTS

| | | | |
|---|---|---|---|
| 3,635,271 | 1/1972 | Markham . | |
| 3,650,481 | 3/1972 | Conery et al. . | |
| 4,081,146 | 3/1978 | Yagi | 241/259.3 X |
| 4,319,718 | 3/1982 | Snavely et al. . | |
| 4,378,093 | 3/1983 | Keener | 241/46.06 X |

*Primary Examiner*—Mark Rosenbaum
*Assistant Examiner*—Frances Chin
*Attorney, Agent, or Firm*—Milton E. Kleinman; Robert S. Smith

[57] ABSTRACT

A grinder pump which includes a housing; a shaft disposed within the housing having an axis; apparatus for mounting the shaft within the housing for rotational movement thereof; a moveable cutter carried on the shaft, apparatus for coupling the moveable cutter to the shaft to cause rotation of the moveable cutter upon rotation of the shaft. A stationary cutter is carried by the housing and the moveable cutter cooperates with the stationary cutter to perform cutting along respective surfaces of the moveable cutter and the stationary cutter. The respective surfaces of the stationary and moveable cutters are substantially within a plane that is substantially perpendicular to the axis; and apparatus resiliently biases the moveable cutter against the stationary cutter.

15 Claims, 2 Drawing Sheets

SEWAGE PUMP WITH SELF-ADJUSTING CUTTERS

BACKGROUND OF THE INVENTION

The invention relates to pumps and particularly to so-call grinder pumps typically used for pumping sewage and which includes structure for cutting of solids in the material being pumped.

Grinder pumps will be understood to be intended to grind solids such as those found in sewage so that the ground particles may be transferred through the system in smaller diameter pipes without clogging problems. One application for such pumps is in residential sewage systems where such pumps may be used between a house and a sewer transfer station or sewer main. When used in this manner, a smaller diameter pipe may be used between the house and the transfer station or sewer main without clogging problems. Thus, the cost for installing the system will be less because of the reduced size of the pipe required.

It will be understood that the present invention has particular application for use in residential applications, although various embodiments, and particularly large embodiments of the present invention, have application to use in sewage which feed into large sewer conduits as well as application for use in sewage plants themselves.

The prior art includes a variety of grinder pumps including that disclosed in U.S. Pat. No. 3,650,481. A number of other related apparatus are described in that patent.

A problem with the prior art grinder pumps is that the cutters become dull and also wear and thus increase the gap between the stationary and moving cutter elements. When the gap becomes too large, the effectiveness of the pump decreases until the pump will not function adequately.

The problems of wear and dulling of the cutters are interrelated. More specifically, as the gap becomes greater, the cutters are more subject to additional wear which not only increases the gap, but also still further decreased the sharpness of the cutters.

Those skilled in the art will understand that a clearance of 0.0025 inch or smaller is ordinarily desirable between the stationary and moving axially extending cutters. Gaps that are larger than this may allow materials such as rags to get caught in the gap thus causing the pump to stall or otherwise malfunction.

Typically, grinder pumps utilize stationary, radially extending and axially extending cutters. A stationary and radially extending cutter cut the waste into longitudinal strips. The axially extending cutters take the long strips and cut them into smaller pieces which are literally axial sections of the strips.

It is an object of the present invention to provide a grinder pump which will have a relatively long service life and particularly a grinder pump that substantially eliminates the prior art problem of wear and dullness and large gaps between the stationary and the moving cutter elements as well as repetitive adjustment of cutters, thus, eliminating repetitive manual adjustment of the cutters.

It is another object of the invention to provide apparatus which will provide a structure which will make the axial cutters and the stationary cutters associated therewith self sharpening and which will maintain the proper clearance therebetween.

It is an object of the invention to provide a grinder pump which has a longer life and requires less maintenance.

SUMMARY OF THE INVENTION

It has now been found that these and other objects of the invention may be attained in a grinder pump which includes a housing, a shaft disposed within said housing having an axis, and means for mounting said shaft within said housing for rotational movement thereof. The apparatus also includes a moveable cutter carried on said shaft, means for coupling said moveable cutter to said shaft to cause rotation of said moveable cutter upon rotation of said shaft, and a stationary cutter carried by said housing. The moveable cutter cooperates with said stationary cutter to perform cutting along respective surfaces of said moveable cutter and said stationary cutter and said respective surfaces of said stationary and moveable cutters are substantially within a plane that is substantially perpendicular to said axis. The apparatus further includes means resiliently biasing said moveable cutter against said stationary cutter.

This embodiment of the apparatus in accordance with the invention may have a means for coupling that includes a spline interface between said shaft and said moveable cutter. The means for biasing may include a spring and the spring may be a coil spring. The coil spring may be disposed in substantially coaxial relationship to the axis of said shaft.

BRIEF DESCRIPTION OF THE DRAWING

The invention will be better understood by reference to the accompanying drawing which is an axial cross section of a grinder pump in accordance with a one form of the present invention.

DESCRIPTION OF THE PREFERRED EMBODIMENT

Figure 1:
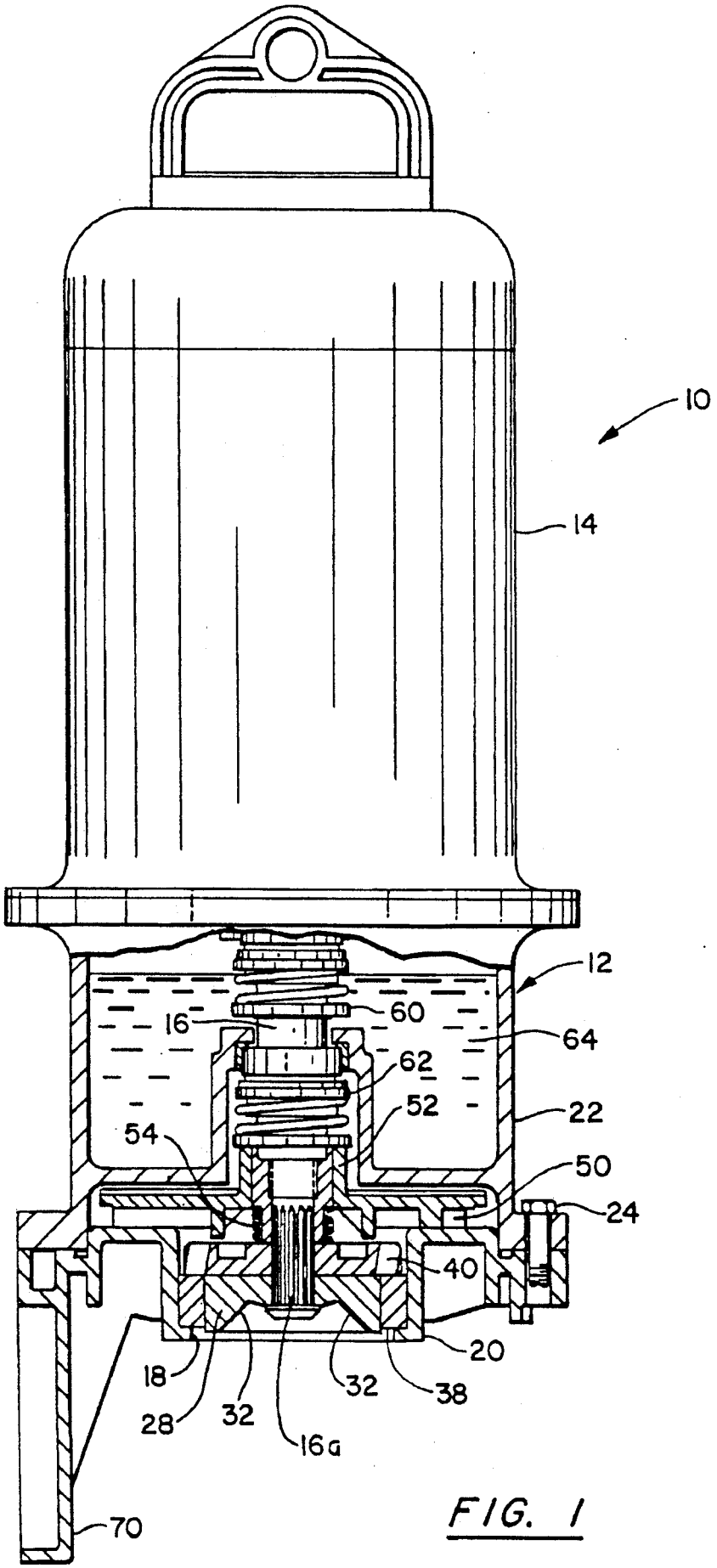
FIG. 1: An axial cross section of a grinder pump.
Figure 2:
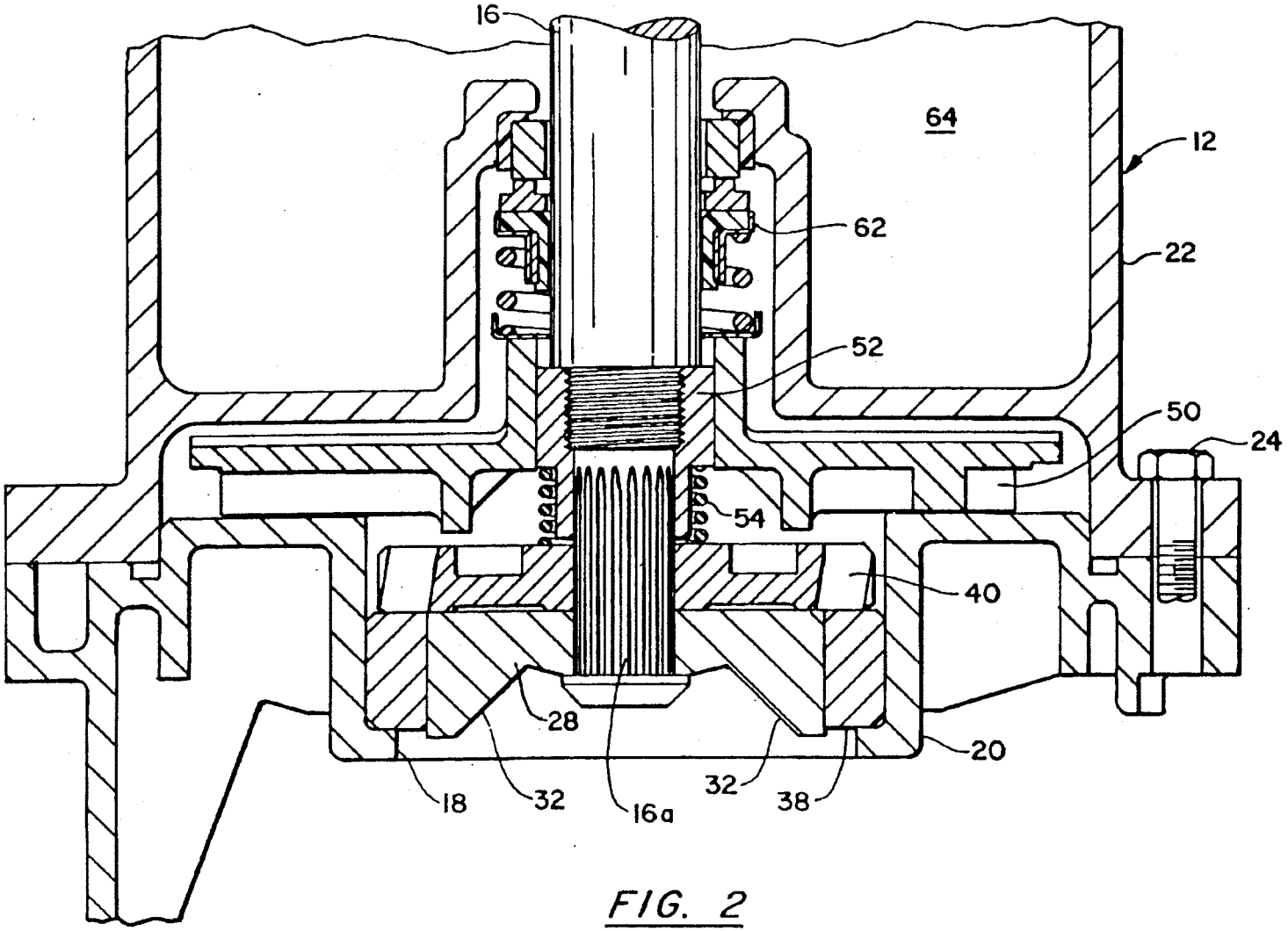
FIG. 2: A view of the cutters in the grinder pump.

Referring now to the drawing there is shown a grinder pump 10 that includes a housing 12 and oil filled electric motor 14. The electric motor 14 has a shaft 16 which extends axially downward (as viewed) to an inlet 18 provided at one end of the housing 12. The inlet 18 is formed in an inlet ring 20 that is secured to a section 22 of the housing 12 by screws 24 or the like. The inlet ring 20 preferably has a plurality of cutting or grinder teeth (not shown) formed therein which extends generally axially with respect to the shaft 16. The lower most (as viewed) axial extremity of the shaft 16 has mounted thereon an inlet cutter blade member or radial cutter 28. The radial cutter 28 has at least a pair of axially extending cutter blades 32, 32 which are customary formed integrally therewith.

The initial grinding and cutter action is obtained in the grinder pump 10 by cooperation of the radial cutter 28 with a stationary cutter 38 that has an annular form and is fixed within a recess in the inlet ring 20. Ordinarily the stationary cutter 38 will include a plurality of axially spaced teeth or blades in the conventional manner.

Disposed on the shaft 16 is a radial cutter 28. It will be understood that the term "radial cutter" refers to a rotor that has a generally radially extending blade. The radial cutter 28 is axially adjacent to an axial cutter 40. The axial cutter 40 has axially extending blades which have radially extending cutting surfaces. Both the radial and axial cutters are mounted for sliding axial movement along a spline 16a on the shaft 16. The spline 16a is disposed on the lower (as viewed) extremity of the shaft 16. Thus the radial cutter 28 and axial cutter 40 are free to move axially along that spline 16a on the shaft 16. An impeller 50 is fixed to a sleeve 52 disposed axially adjacent to the axial cutter 40. The sleeve 52 is threaded to the shaft 16 and does not move relative to the shaft 16. The sleeve 52 includes a shoulder which is engaged by a coil spring 54 that pushes against the axial cutter 40 to maintain the proper clearance between the axial cutter 40 and the stationary cutter 38. It will thus be seen that the coil spring 54 provides positive contact between the axial cutter 40 and the stationary cutter 38 for correct operation and self sharpening of the axial cutter 40.

It will also be understood that the biasing action of the coil spring 54 insures that this positive contact of cutting surfaces of the axial cutter 40 against the stationary cutter 38 avoids jamming of materials such as rags in between the axial cutter and the stationary cutter in addition to maintaining sharpness of the respective cooperating surfaces because of the positive contact therebetween. This is in contrast to prior art apparatus which typically used nuts and other threaded surfaces to hold the axial cutter against the stationary cutter.

Ordinarily, the radial cutter will have substantially line contact with the cooperating surface of the stationary cutter. In contrast, the axial cutter 40 typically has substantially point contact with the cooperating surfaces of the stationary cutter 38 much as a pair of scissors or a paper cutter has substantially point contact between the two cutting elements at any instance. This construction, of course, means that the forces are concentrated at a relatively small area so that cutting can be accomplished more easily. Although these noted constructions involving line and point contact are preferred, it will be understood that in various embodiments of the present invention either form may be used.

It will be understood that the term "radial cutter" refers to a rotating cutting element which cooperates with a stationary element and which has an interface therebetween which is along one or more lines which extend generally parallel to the axis of rotation of the revolving radial cutter. It will be further understood that the term "axial cutter" refers to a rotating cutter which cooperates with a stationary cutter and has cutting elements upon these respective surfaces which are disposed substantially in a plane which is substantially perpendicular to the axis of a shaft upon which the axial cutter rotates.

In the conventional manner, the apparatus includes seals 60, 62 to isolate the material being pumped by the impeller 50 from the oil filled chamber 64 which is disposed axially intermediate the oil filled electric motor 14 and the impeller 50. The apparatus includes legs 70 (one shown) to support the apparatus in a reservoir.

It will be understood that, although the present invention has been described in terms of an impeller, a radial cutter and an axial cutter all being connected by a spline to a shaft, it is of greatest significance to have the axial cutter mounted in this or a similar manner so that the cutting surfaces are forced together by the spring.

Although the preferred embodiment includes a spline coupling the shaft to the axial cutter, it will be understood that other coupling means may be used such as one or more elongated keys which extend axial along a face of the shaft and cooperate with a recess in the axial cutter.

Although the invention has been described with respect to a stacked arrangement of a radial cutter, an axial cutter and an impeller, it will be understood that various other arrangements are possible, even though this combination is particularly desirable. More particularly, other embodiments of the invention may merely use a structure which biases the axial cutter against the stationary cutter and which mounts the axial cutter or axial movement on a shaft while still coupling the axial cutter to the shaft to cause the axial cutter to rotate upon rotation of the shafts.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the appended claims.

Having thus described my invention I claim:

1. A grinder pump which comprises:

a housing;

a shaft disposed within said housing having an axis;

means for mounting said shaft within said housing for rotational movement thereof;

a moveable cutter carried on said shaft;

means for coupling said moveable cutter to said shaft to cause rotation of said moveable cutter upon rotation of said shaft;

a stationary cutter carried by said housing, said moveable cutter cooperating with said stationary cutter to perform cutting along respective surfaces of said moveable cutter and said stationary cutter, said respective surfaces of said stationary and moveable cutters being substantially within a plane that is substantially perpendicular to said axis; and means for self sharpening of said moveable cutter and means for avoiding jamming of materials intermediate said moveable cutter and said stationary cutter comprising means resiliently biasing said moveable cutter against said stationary cutter.

2. The apparatus as described in claim 1 wherein:

said means for coupling comprises a spline interface between said shaft and said moveable cutter.

3. The apparatus as described in claim 2 wherein:

said means for biasing comprises a spring.

4. The apparatus as described in claim 3 wherein:

said spring is a coil spring.

5. The apparatus as described in claim 4 wherein:

said coil spring is disposed in substantially coaxial relationship to the axis of said shaft.

6. A grinder pump which comprises:

a housing;

a shaft disposed within said housing having an axis; means for mounting said shaft within said housing for rotational movement thereof;

a moveable cutter having a first cutting edge, said moveable cutter being carried on said shaft;

means for coupling said moveable cutter to said shaft to cause rotation of said moveable cutter upon rotation of said shaft;

a stationary cutter carried by said housing, said stationary cutter having a second cutting edge, said second cutting edge cooperating with said first cutting edge to perform cutting along said cutting edges of said moveable cutter and said stationary cutter; and means for self sharpening of said moveable cutter and means for avoiding jamming of materials intermediate said moveable cutter and said stationary cutter comprising means resiliently biasing said first cutting edge against said second cutting edge.

7. The apparatus as described in claim 6 wherein:

said means for coupling comprises a spline interface between said shaft and said moveable cutter.

8. The apparatus as described in claim 7 wherein:

said means for biasing comprises a spring.

9. The apparatus as described in claim 8 wherein:

said spring is a coil spring.

10. The apparatus as described in claim 9 wherein:

said coil spring is disposed in substantially coaxial relationship to the axis of said shaft.

11. A grinder pump which comprises:

a housing;

a shaft disposed within said housing having an axis;

means for mounting said shaft within said housing for rotational movement thereof;

a moveable cutter having a first cutting edge, said moveable cutter being carried on said shaft;

a second moveable cutter carried on said shaft, said second movable cutter having axial cutting surfaces;

means for coupling said second moveable cutter to said shaft to cause rotation of said second moveable cutter upon rotation of said shaft;

a stationary cutter carried by said housing, said second moveable cutter cooperating with said stationary cutter to perform cutting along respective surfaces of said second moveable cutter and said stationary cutter; and means for self sharpening of said moveable cutter and means for avoiding jamming of materials intermediate said moveable cutter and said stationary cutter comprising means resiliently biasing said second moveable cutter against said stationary cutter.

12. The apparatus as described in claim 11 wherein:

said means for coupling comprises a spline interface between said shaft and said second moveable cutter.

13. The apparatus as described in claim 12 wherein:

said means for biasing comprises a spring.

14. The apparatus as described in claim 13 wherein:

said spring is a coil spring.

15. The apparatus as described in claim 14 wherein:

said coil spring is disposed in substantially coaxial relationship to the axis of said shaft.

* * * * *